US008387226B2

(12) United States Patent
Weigel, Jr. et al.

(10) Patent No.: US 8,387,226 B2
(45) Date of Patent: Mar. 5, 2013

(54) METHOD AND APPARATUS FOR REMOVING BLIND FASTENERS

(75) Inventors: Matthew J. Weigel, Jr., Bonney Lake, WA (US); Sujith N. Mally, Bellevue, WA (US)

(73) Assignee: The Boeing Company, Chicago, IL (US)

( * ) Notice: Subject to any disclaimer, the term of this patent is extended or adjusted under 35 U.S.C. 154(b) by 1021 days.

(21) Appl. No.: 12/330,249

(22) Filed: Dec. 8, 2008

(65) Prior Publication Data

US 2011/0000064 A1 Jan. 6, 2011

(51) Int. Cl.
*B23P 19/02* (2006.01)

(52) U.S. Cl. ..... 29/426.4; 29/42.01; 29/402.06; 29/426.1; 29/426.5

(58) Field of Classification Search ..... 29/402.01, 29/402.04, 402.06, 426.1, 426.4, 426.5
See application file for complete search history.

(56) References Cited

U.S. PATENT DOCUMENTS

| | | | | |
|---|---|---|---|---|
| 4,813,820 | A * | 3/1989 | Cadwell et al. | 408/1 R |
| 6,213,698 | B1 | 4/2001 | Cosenza | |
| 7,555,820 | B2 * | 7/2009 | McEldowney et al. | 29/426.4 |
| 2009/0274526 | A1 * | 11/2009 | Jenkins et al. | 408/115 B |

* cited by examiner

*Primary Examiner* — Derris Banks
*Assistant Examiner* — Azm Parvez
(74) *Attorney, Agent, or Firm* — Yee & Associates, P.C.

(57) ABSTRACT

A method and apparatus are present for removing a blind fastener from a structure. A first hole is drilled in a guide located around a center of a head of a core bolt in a body of the blind fastener to form a pilot hole. A second hole is drilled in the pilot hole in the head of the core bolt. The head of the core bolt is separated from the shaft of the core bolt. The core bolt is separated from the body. The core bolt is moved out of the body after the core bolt has been separated from the body. A head of the body is separated from a shaft of the body. The shaft of the body is moved out of the structure.

15 Claims, 10 Drawing Sheets

1300

| FASTENER REMOVAL CHART | | | | | | | |
|---|---|---|---|---|---|---|---|
| FASTENER SIZE 1302 | COREBOLT, HEAD PILOT DRILL DIAMETER 1304 | PILOT DRILL DEPTH (APPROXIMATE) 1306 | COREBOLT, SHANK DRILL DIAMETER 1308 | SHANK DRILL DEPTH (APPROXIMATE) 1310 | BODY, HEAD COUNTERBORE DRILL DIAMETER 1312 | COUNTERBORE DRILL DEPTH (APPROXIMATE) 1314 | BODY, HEAD REMOVAL PUNCH 1316 |
| 1318 -6 (3/16) | .082 | .10 | .136 | .05 | .154/.182 | .06 | .154/.182 |
| 1320 -8 (1/4) | .111 | .12 | .187 | .06 | .205/.242 | .08 | .205/.242 |
| 1322 -10 (5/16) | .125 | .14 | .238 | .07 | .257/.302 | .09 | .257/.302 |
| 1324 -12 (3/8) | .187 | .16 | .290 | .08 | .309/.368 | .10 | .309/.368 |

FIG. 13

1400

1. Locate the center of the fastener and core bolt on the head side of the fastener.
2. Center punch the core bolt head with a center punch.
3. Using a small drill bit (refer to the fastener removal chart), drill a pilot hole approximately 1/8 of an inch deep in the core bolt head.
4. Using the core bolt drill, drill through the pilot hole to the 1/8 inch depth or when the core bolt head snaps off, whichever happens first.
5. Take a punch or rivet set tool and rivet gun to remove the core bolt. This step should be performed by a rivet gun qualified person. Use only enough force as necessary to remove the core bolt.
6. Use the non-cutting piloted counter bore drill and a low rpm (below 400 rpm) drill motor. Drill a counter bore into the fastener body to the approximate depth in the fastener removal chart.
7. Take the piloted step punch, insert the small end into the fastener body.
8. Using a hammer or rivet gun lightly tap the punch to remove the fastener head from the body of the fastener.
9. Repeat to remove fasteners as necessary.

FIG. 14

METHOD AND APPARATUS FOR REMOVING BLIND FASTENERS

BACKGROUND INFORMATION

1. Field

The present disclosure relates generally to fastening systems and, in particular, to a method and apparatus for removing fasteners from parts.

2. Background

In manufacturing aircraft, various parts for the aircraft may be connected to each other to form structures or substructures. For example, with aircraft, skin panels for surfaces on an aircraft may be attached to an airframe of the aircraft. The attachment of these skin panels may be made using fasteners. Installation of blind fasteners on aircraft surfaces typically is performed in a manner such that the fasteners are flush to the surface. In some cases, access to the opposite side of the skin panel may be difficult and/or unavailable.

This lack of access may complicate installing fasteners for skin panels. With this type of situation, a blind fastener may be used when access may be available on only one side of a skin panel.

A blind fastener may have an internally threaded body and an externally threaded core bolt that may pass through the internally threaded body. One end of the core bolt has an enlarged head, while the other end has an engaging portion. The engaging portion may include an annealed portion is the part of the body that may collapse to secure the fastener to the parts. The engaging portion may be placed through holes for parts that are aligned for attachment.

By turning the core bolt relative to the body, the core bolt may move in an axial direction outward from the body. This axial outward movement may cause a portion of the body to deform in a manner to engage an inner surface of the part. This deformation secures the blind fastener in place, attaching the parts to each other. When installing a blind fastener, a portion of the head of the core bolt typically fractures leaving a flush surface on the installed fastener head.

During assembly and manufacturing of an aircraft, it may be necessary to rework portions of an aircraft such as skin panels. Further, the removal of skin panels also may be necessary during maintenance after the aircraft is in service. The maintenance or reworking may require removal of the skin panel. The maintenance or reworking also may be needed if a portion of the core bolt breaks prematurely, the blind fastener becomes damaged, an incorrect grip length for the fastener was installed, or some other condition occurs that may require the fastener to be removed.

Installed blind fasteners cannot be easily removed if access to the opposite side of the skin panel is unavailable. Removal of these fasteners may currently be performed by drilling through the head of a blind fastener and pushing the remaining portion of the blind fastener through the hole after removal of the head.

Drilling through the head of a blind fastener requires precision in drilling a hole through the fastener to avoid damaging the skin panel. This process is time consuming to perform in a manner that avoids damage to the skin panel. If the skin panel is damaged during removal of the blind fastener, the skin panel may require repair, reworking, and/or replacement. As a result, operations involving the removal of blind fasteners may be time consuming. Further, these operations also may increase the expense of work being performed if structures are damaged during removal of the blind fasteners.

Therefore, it would be advantageous to have a method and apparatus that overcomes one or more of the issues described above.

SUMMARY

In one advantageous embodiment, a method is present for removing a blind fastener from a structure. A first hole is drilled in a guide located around a center of a head of a core bolt in a body of the blind fastener to form a pilot hole. A second hole is drilled in the pilot hole in the head of the core bolt. The head of the core bolt is separated from the shaft of the core bolt. The core bolt is separated from the body. The core bolt is moved out of the body after the core bolt has been separated from the body. A head of the body is separated from a shaft of the body. The shaft of the body is moved out of the structure.

In another advantageous embodiment, a method is present for removing a blind fastener from an aircraft part. A guide is formed around a center of a head of a core bolt in the blind fastener with a center punch. A first hole is drilled in the guide located around the center of the head of the core bolt in a body of the blind fastener with a first drill bit having a first diameter to a first depth to form a pilot hole. A second hole is drilled in the pilot hole in the head of the core bolt with a second drill bit having a second diameter to a selected depth at which the head of the core bolt separates from a shaft of the core bolt. The first diameter is smaller than the second diameter. A force is applied with a punch to separate the core bolt from the body. The core bold is moved out of the body after the core bolt has been separated from the body. A counter bore is drilled into a head of the body. A force is applied with a step punch to separate the head of the body from a shaft of the body. The shaft of the body is moved out of a structure.

In yet another advantageous embodiment, a kit is present for removing blind fasteners and contains a plurality of tools and a set of instructions directing an operator. The set of instructions may direct an operator to form a guide around a center of a head of a core bolt in a body of a blind fastener. The set of instructions may direct an operator to drill a first hole in the guide to a selected depth to form a pilot hole. The set of instructions may further direct an operator to drill a second hole in the pilot hole in the head of the core bolt to a particular depth. The set of instructions may direct an operator to separate the head of the core bolt from the shaft of the core bolt. The set of instructions may direct an operator to separate the core bolt from the body. The set of instructions may direct an operator to move the core bolt out of the body after the core bolt has been separated from the body. The set of instructions may further direct an operator to separate a head of the body from a shaft of the body and move the shaft of the body out of the structure.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the advantageous embodiments are set forth in the appended claims. The advantageous embodiments, however, as well as a preferred mode of use, further objectives, and advantages thereof, will best be understood by reference to the following detailed description of an advantageous embodiment of the present disclosure when read in conjunction with the accompanying drawings, wherein:

FIG. 13 is a table illustrating tools and depths needed to remove blind fasteners in accordance with an advantageous embodiment;

FIG. 14 is a diagram illustrating instructions in accordance with an advantageous embodiment;

DETAILED DESCRIPTION

Figure 1:
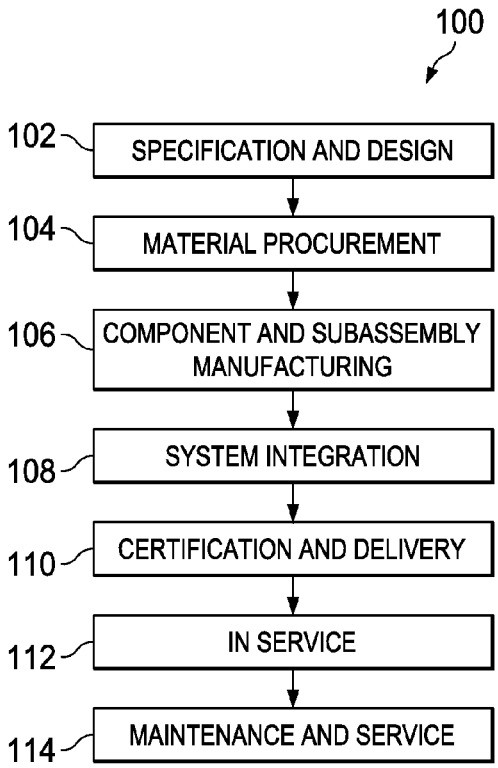
FIG. 1 is a diagram illustrating an aircraft manufacturing and service method in accordance with an advantageous embodiment.
Figure 2:
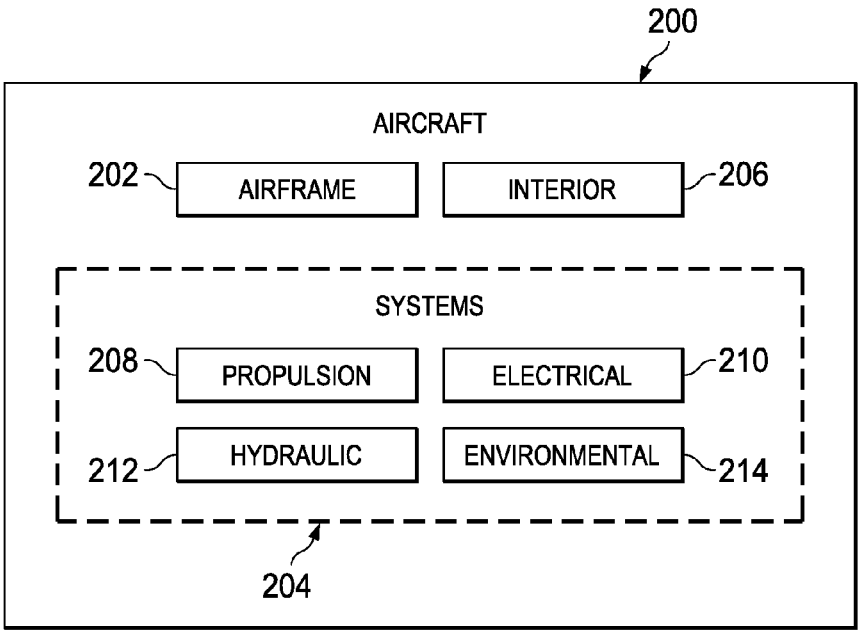
FIG. 2 is a diagram of an aircraft in which an advantageous embodiment may be implemented.

Referring more particularly to the drawings, embodiments of the disclosure may be described in the context of the aircraft manufacturing and service method 100 as shown in FIG. 1 and aircraft 200 as shown in FIG. 2. Turning first to FIG. 1, a diagram illustrating an aircraft manufacturing and service method is depicted in accordance with an advantageous embodiment. During pre-production, exemplary aircraft manufacturing and service method 100 may include specification and design 102 of aircraft 200 in FIG. 2 and material procurement 104.

During production, component and subassembly manufacturing 106 and system integration 108 of aircraft 200 in FIG. 2 takes place. Thereafter, aircraft 200 in FIG. 2 may go through certification and delivery 110 in order to be placed in service 112. While in service by a customer, aircraft 200 in FIG. 2 is scheduled for routine maintenance and service 114, which may include modification, reconfiguration, refurbishment, and other maintenance or service.

Each of the processes of aircraft manufacturing and service method 100 may be performed or carried out by a system integrator, a third party, and/or an operator. In these examples, the operator may be a customer. For the purposes of this description, a system integrator may include, without limitation, any number of aircraft manufacturers and major-system subcontractors; a third party may include, without limitation, any number of venders, subcontractors, and suppliers; and an operator may be an airline, leasing company, military entity, service organization, and so on.

With reference now to FIG. 2, a diagram of an aircraft is depicted in which an advantageous embodiment may be implemented. In this example, aircraft 200 is produced by aircraft manufacturing and service method 100 in FIG. 1 and may include airframe 202 with a plurality of systems 204 and interior 206. Examples of systems 204 include one or more of propulsion system 208, electrical system 210, hydraulic system 212, and environmental system 214. Any number of other systems may be included. Although an aerospace example is shown, different advantageous embodiments may be applied to other industries, such as the automotive industry.

Apparatus and methods embodied herein may be employed during any one or more of the stages of aircraft manufacturing and service method 100 in FIG. 1. For example, components or subassemblies produced in component and subassembly manufacturing 106 in FIG. 1 may be fabricated or manufactured in a manner similar to components or subassemblies produced while aircraft 200 is in service 112 in FIG. 1.

Also, one or more apparatus embodiments, method embodiments, or a combination thereof may be utilized during production stages, such as component and subassembly manufacturing 106 and system integration 108 in FIG. 1, for example, without limitation, by substantially expediting the assembly of or reducing the cost of aircraft 200. Similarly, one or more of apparatus embodiments, method embodiments, or a combination thereof may be utilized while aircraft 200 is in service 112 or during maintenance and service 114 in FIG. 1.

For example, one or more advantageous embodiments may be implemented during component and subassembly manufacturing and maintenance and service 114 to remove blind fasteners from structures. The different advantageous embodiments provide a method and apparatus for removing blind fasteners from structures in a manner that may reduce reworking and damage to the structures.

Thus, the different advantageous embodiments provide a method and apparatus for removing a blind fastener from a structure. A hole may be drilled in a guide located around a center of a head of a core bolt in a body of a blind fastener to form a pilot hole. A hole may be drilled in the pilot hole in the head of the core bolt to a selected depth. In these examples, the selected depth is one at which the head of the core bolt separates from the shaft of the core bolt. The core bolt is then separated from the body. The core bolt is driven out of the body. The head of the body is then separated from the shaft of the body. The shaft is then moved out of the structure.

Figure 3:
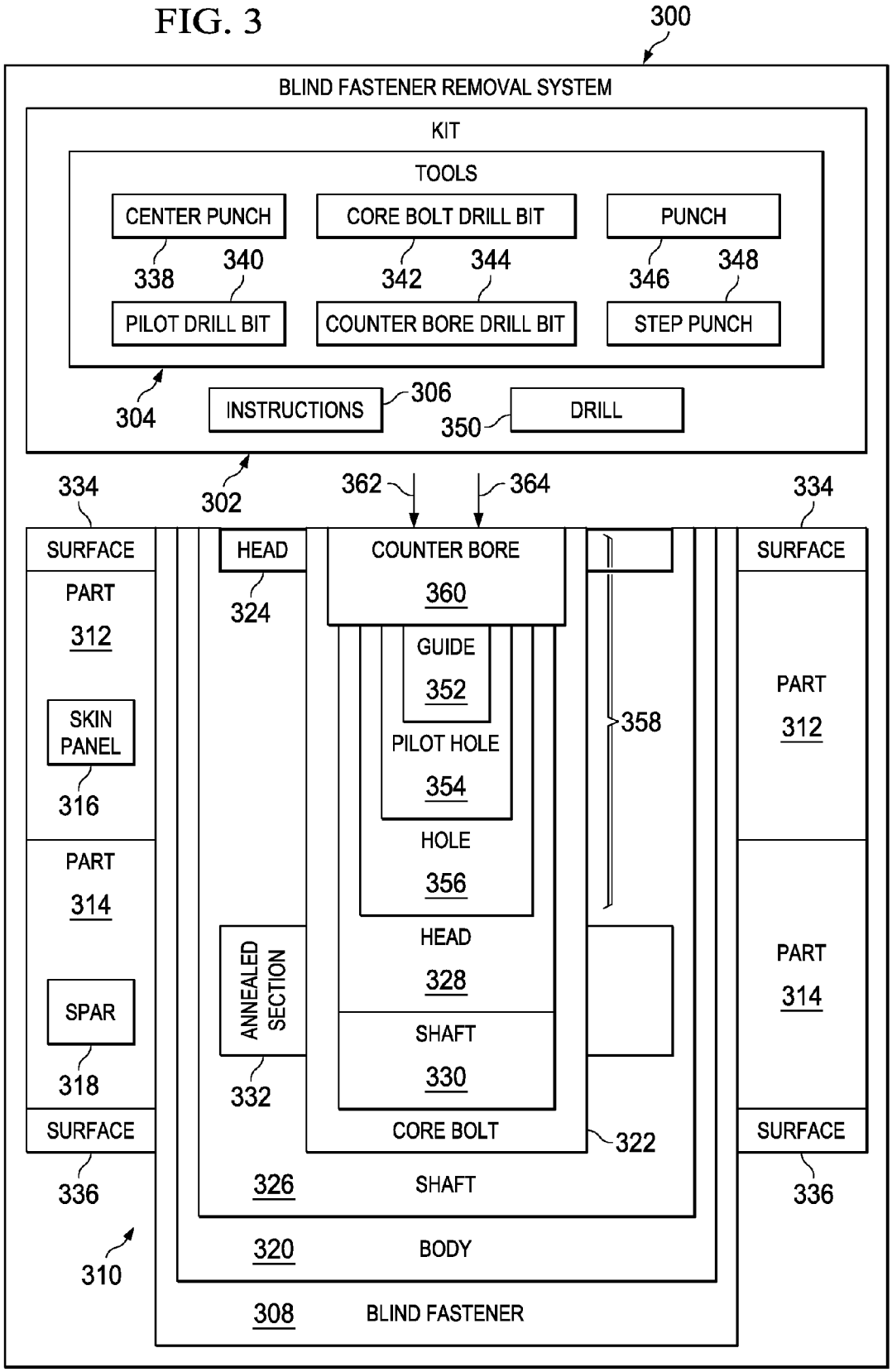
FIG. 3 is a block diagram illustrating a blind fastener removal system in accordance with an advantageous embodiment.

With reference now to FIG. 3, a block diagram illustrating a blind fastener removal system is depicted in accordance with an advantageous embodiment. In this example, blind fastener removal system 300 may be used to remove blind fasteners from structures within an object such as, for example, aircraft 200 in FIG. 2.

Blind fastener removal system 300 includes kit 302. Kit 302 may contain tools 304 and instructions 306. Tools 304 may be used to remove blind fastener 308 from structure 310. In these examples, structure 310 may include parts 312 and 314, which are attached to each other by blind fastener 308. One or more of parts 312 and 314 may be composite parts in these examples. Part 312 may be skin panel 316, while part 314 may be spar 318.

In this example, blind fastener 308 has body 320 and core bolt 322. Body 320 is threaded on the interior, while core bolt 322 is threaded on the exterior surface. Core bolt 322 may be located within body 320. Body 320 has head 324 and shaft 326. Core bolt 322 has head 328 and shaft 330. Shaft 326 of body 320 has annealed section 332, which may collapse to secure blind fastener 308 within a hole for parts such as parts 312 and 314 in structure 310.

In these examples, head 328 of core bolt 322 is flush to surface 334, while a collapsed portion of annealed section 332 is located on surface 336, which is opposite to surface 334. Surface 336, in these examples, may be an inaccessible surface. In other words, an operator or other user may be unable to reach surface 336 when removing blind fastener 308 from part 312 and part 314.

Kit 302 may be used to remove blind fastener 308. In these examples, tools 304 within kit 302 may include center punch 338, pilot drill bit 340, core bolt drill bit 342, counter bore drill bit 344, punch 346, and step punch 348. Drill 350 also may be used, but may or may not be part of kit 302, depending on the particular implementation. An operator may use tools 304 in accordance with instructions 306 to remove blind fastener 308. Instructions 306 may provide a list of operations and an identification of tools for use with each operation to remove blind fastener 308 from structure 310.

Center punch 338 may be used to create guide 352 in head 328 of core bolt 322. Guide 352 may be located centrally on head 328 of core bolt 322. Pilot drill bit 340 may be used to drill pilot hole 354 in guide 352 when used in conjunction with drill 350. After pilot hole 354 has been created, hole 356 may be drilled into pilot hole 354 to selected depth 358. Selected depth 358 may be a depth at which head 328 of core bolt 322 separates from shaft 330 of core bolt 322.

Next, core bolt 322 is separated from body 320 of blind fastener 308. This separation occurs at annealed section 332 in these examples. The separation of core bolt 322 from body 320 may be performed by applying force 362 using punch 346. If head 328 did not separate from the drilling of hole 356, head 328 may be separated by the application of force 362 when separating core bolt 322 from body 320. Core bolt 322 is then moved out of body 320. In these examples, shaft 330 is a portion of core bolt 322 that remains after head 328 is removed out of body 320.

Next, head 324 of body 320 is separated from shaft 326 of body 320. This separation may occur by drilling counter bore 360 into body 320. Counter bore 360 may be drilled in a manner that reduces the thickness of body 320 around the location where head 324 meets shaft 326 of body 320.

In other words, counter bore 360 reduces a cross section inside of body 320 in a manner that makes it easier to separate head 324 from shaft 326 in a manner that minimizes and/or eliminates damage to structure 310. Force 364 may then be applied using step punch 348. Step punch 348 may have a step that has a sharp edge that may separate head 324 of body 320 from shaft 326 of body 320.

The illustration of blind fastener removal system 300 in FIG. 3 is not meant to imply physical or architectural limitations to the manner in which different advantageous embodiments may be implemented. Other components in addition to, or in place of, the ones illustrated may be used, depending on the particular implementation.

Further, some components may be unnecessary. For example, drill 350 may be part of tools 304 in some advantageous embodiments. In yet other advantageous embodiments, center punch 338, punch 346, and/or step punch 348 may be automated or hand-held tools. In yet other advantageous embodiments, punch 346 may be unnecessary if the depth at which hole 356 is drilled is designed to separate head 328 of core bolt 322 from shaft 330.

Figure 4:
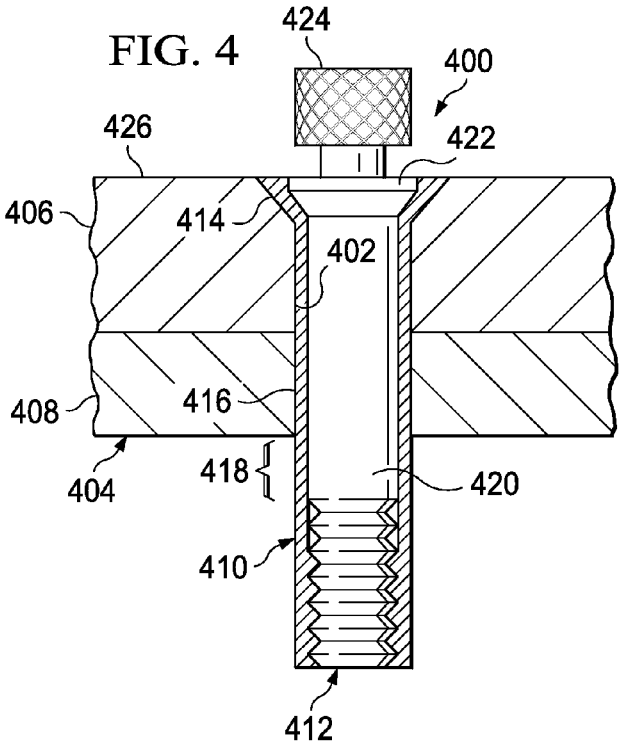
FIG. 4 is a diagram of a blind fastener located within a hole in accordance with an advantageous embodiment.

With reference now to FIGS. 4-12, diagrams illustrating installation and removal of a blind fastener are depicted in accordance with an advantageous embodiment. Turning first to FIG. 4, a diagram of a blind fastener located within a hole is depicted in accordance with an advantageous embodiment. In this example, blind fastener 400 is located within hole 402 of structure 404. Structure 404, in this example, includes part 406 and part 408.

In this example, blind fastener 400 includes body 410 and core bolt 412. Core bolt 412 may be located inside of body 410 as illustrated. Body 410 has head 414 and shaft 416. Shaft 416 has annealed section 418. Annealed section 418 may collapse when core bolt 412 is turned to secure blind fastener 400 within hole 402. Core bolt 412 has shaft 420 and head 422. Head 422 includes blind section 424, which may break off or become detached from head 422 of core bolt 412 after installation of blind fastener 400 to provide a flush surface on surface 426.

Figure 5:
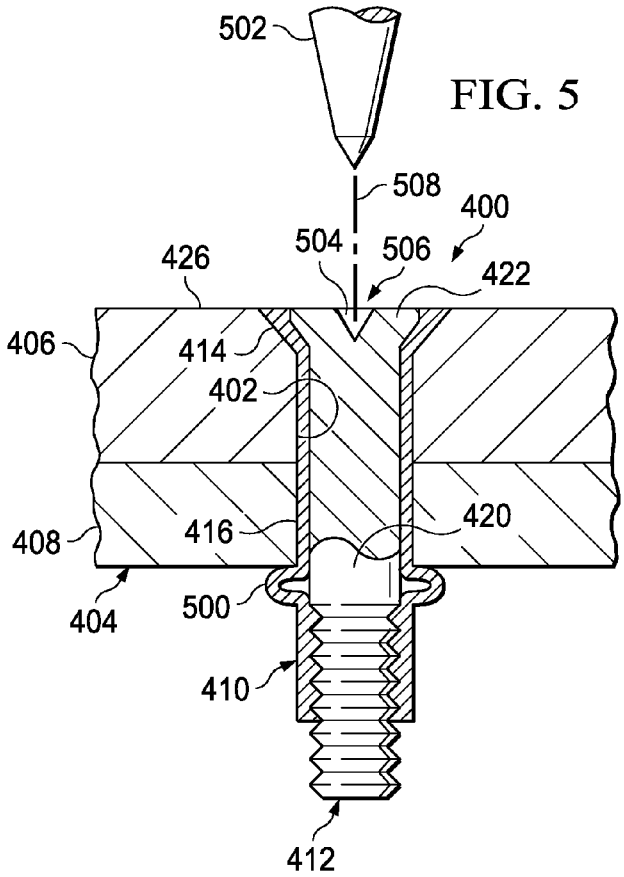
FIG. 5 is a diagram of a secured blind fastener in accordance with an advantageous embodiment.

In FIG. 5, a diagram of a secured blind fastener is depicted in accordance with an advantageous embodiment. Blind fastener 400 has been secured within hole 402. Annealed section 418 has collapsed to form flange 500. Blind fastener 400 may be removed in manner that reduces and/or eliminates damage to structure 404. In this operation, center punch 502 is used to create guide 504 in central location 506 of head 414 of core bolt 412. This central location may be substantially centered along axis 508, which runs axially through blind fastener 400. Guide 504 serves as a guide to drill a pilot hole within blind fastener 400.

Figure 6:
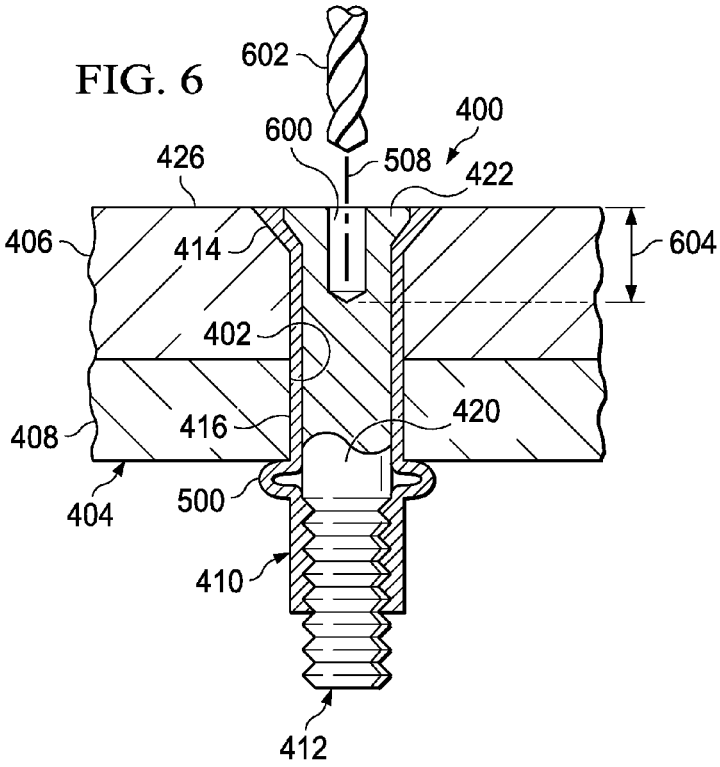
FIG. 6 is a diagram illustrating a pilot hole drilled in a blind fastener in accordance with an advantageous embodiment.

Next, in FIG. 6, a diagram illustrating a pilot hole drilled in a blind fastener is depicted in accordance with an advantageous embodiment. In this example, pilot hole 600 is drilled into core bolt 412 of blind fastener 400. Pilot hole 600 is located along axis 508 with the forming of pilot hole 600 being guided using guide 504. Pilot hole 600 is drilled using pilot hole drill bit 602.

Pilot hole drill bit 602 may be implemented using any drill bit having a diameter that is small enough relative to the diameter of core bolt 412 such that pilot hole 600 may be drilled in a manner that reduces and/or eliminates damage to structure 404. In this example, pilot hole 600 has depth 604. Depth 604 may be identified in a number of different ways. For example, depth 604 may be selected as exceeding a height of head 414 of core bolt 412 within hole 600. In other words, hole 600 may have depth 604 that extends beyond head 414 of core bolt 412.

Figure 7:
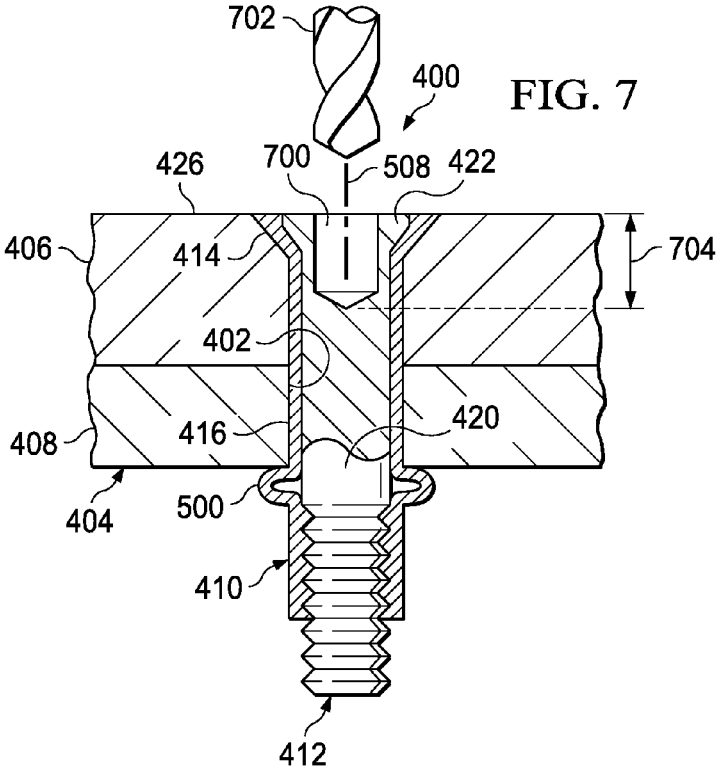
FIG. 7 is a diagram illustrating a hole drilled into a pilot hole in accordance with an advantageous embodiment.

Turning next to FIG. 7, a diagram illustrating a hole drilled into a pilot hole is depicted in accordance with an advantageous embodiment. In this example, hole 700 is drilled into pilot hole 600 using core bolt drill bit 702. Core bolt drill bit 702 may be implemented using any drill bit capable of drilling hole 700 within core bolt 412.

Core bolt drill bit 702 is selected to have a diameter greater than the diameter of pilot hole drill bit 602 in FIG. 6. The diameter of core bolt drill bit 702 is selected such that hole 702 results in a weakening between head 422 of core bolt 412 and shaft 420 of core bolt 412. Hole 700 is drilled to depth 704 such that head 422 separates from shaft 420.

Figure 8:
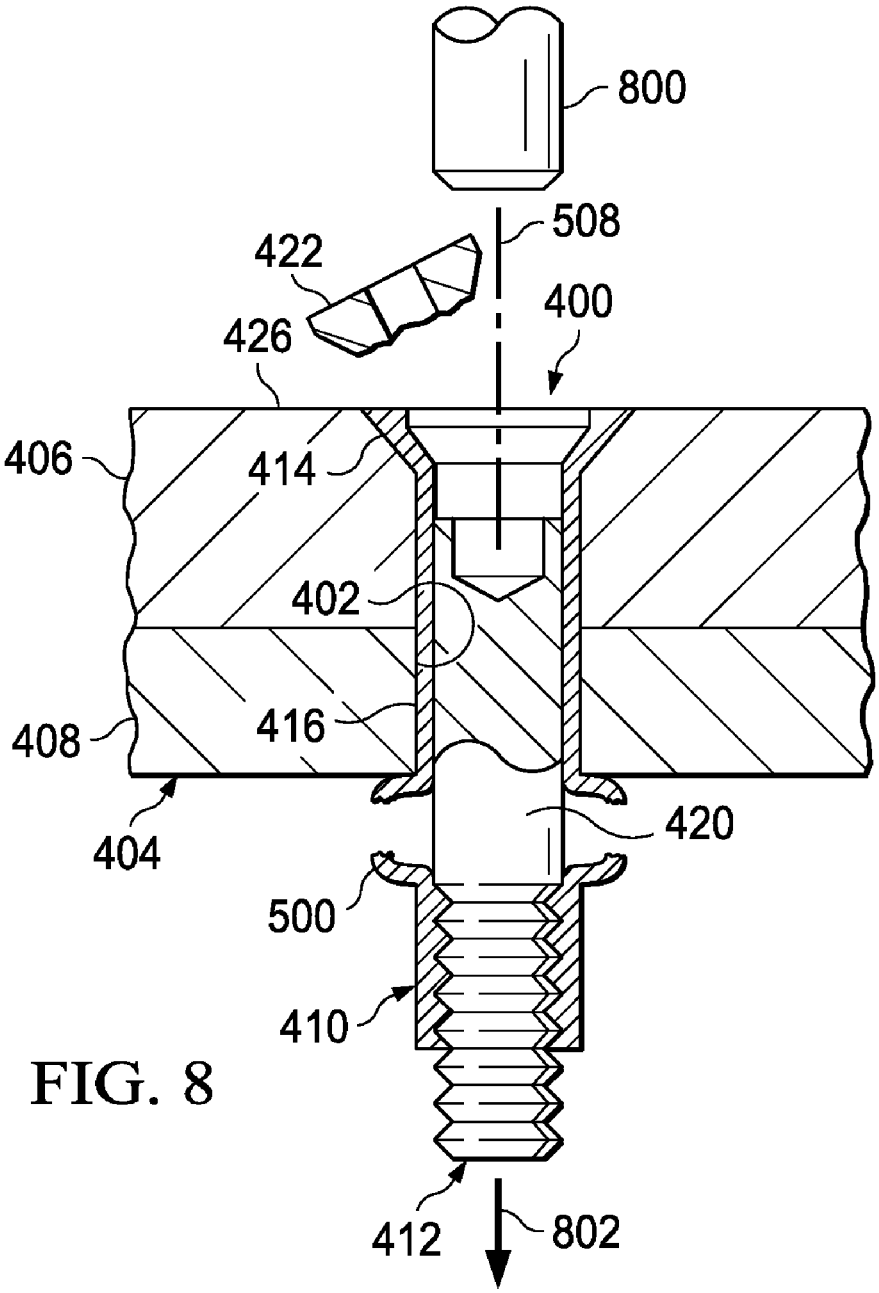
FIG. 8 is a diagram illustrating separation of a head from a shaft of a core bolt in a blind fastener in accordance with an advantageous embodiment.

Turning now to FIG. 8, a diagram illustrating separation of a head from a shaft of a core bolt in a blind fastener is depicted in accordance with an advantageous embodiment. In this illustrative example, punch 800 may be used to separate head 422 from shaft 420 of core bolt 412.

In some advantageous embodiments, head 422 may be separated from shaft 420 of core bolt 412 through drilling hole 700 to depth 704 as shown in FIG. 7. If that occurs, punch 800 may be applied to separate core bolt 412 from body 410.

In this example, flange 500 may fracture or break, separating core bolt 412 from body 410. With this separation, core bolt 412 may be driven or moved out of body 410 in the direction of arrow 802.

Figure 9:
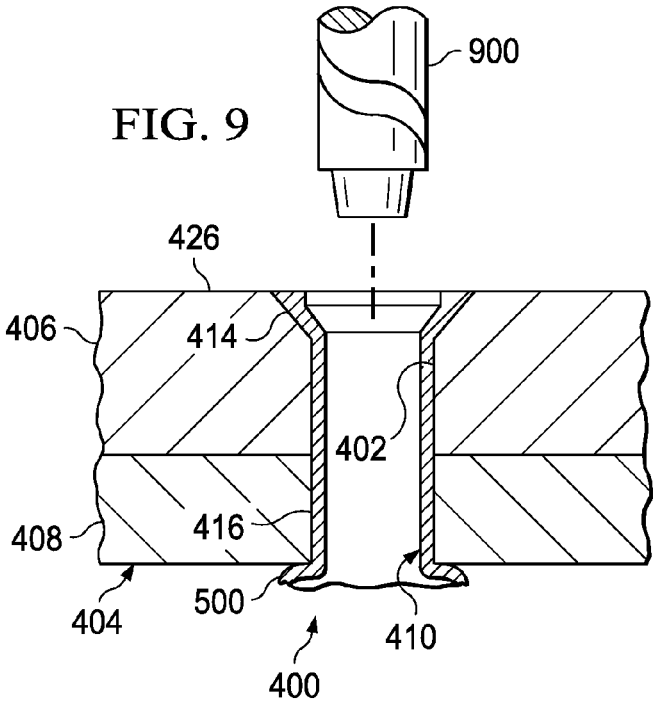
FIG. 9 is a diagram illustrating drilling of a counter bore in a blind fastener in accordance with an advantageous embodiment.

With reference now to FIG. 9, a diagram illustrating drilling of a counter bore in a blind fastener is depicted in accordance with an advantageous embodiment. In this example, only a portion of body 410 remains within hole 402. Counter bore drill bit 900 may be used to drill a counter bore in head 414 of body 410.

Figure 10:
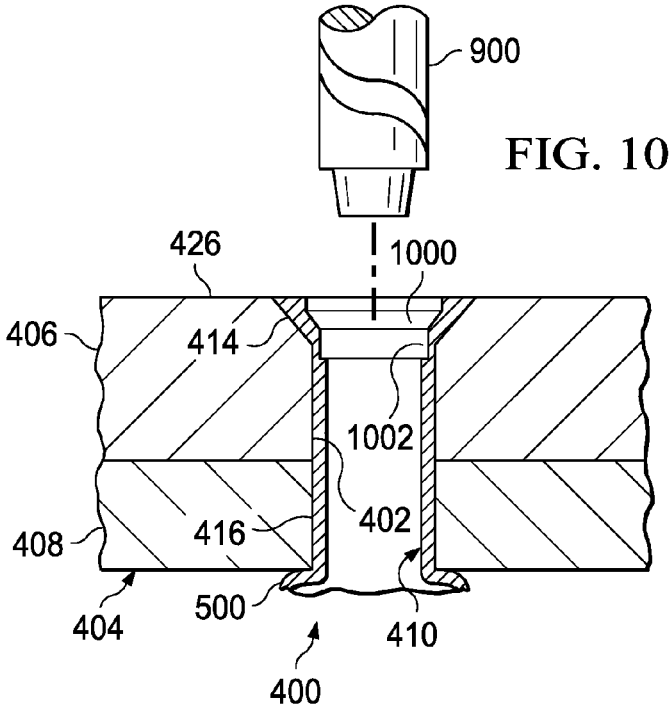
FIG. 10 is a diagram illustrating a counter bore hole in a blind fastener in accordance with an advantageous embodiment.

With reference now to FIG. 10, a diagram illustrating a counter bore hole in a blind fastener is depicted in accordance with an advantageous embodiment. In this example, counter bore drill bit 900 has created counter bore 1000 in body 410. As can be seen, cross section 1002 is reduced within body 410. This reduction in cross section 1002 makes it easier to separate head 414 from shaft 416 of body 410.

Figure 11:
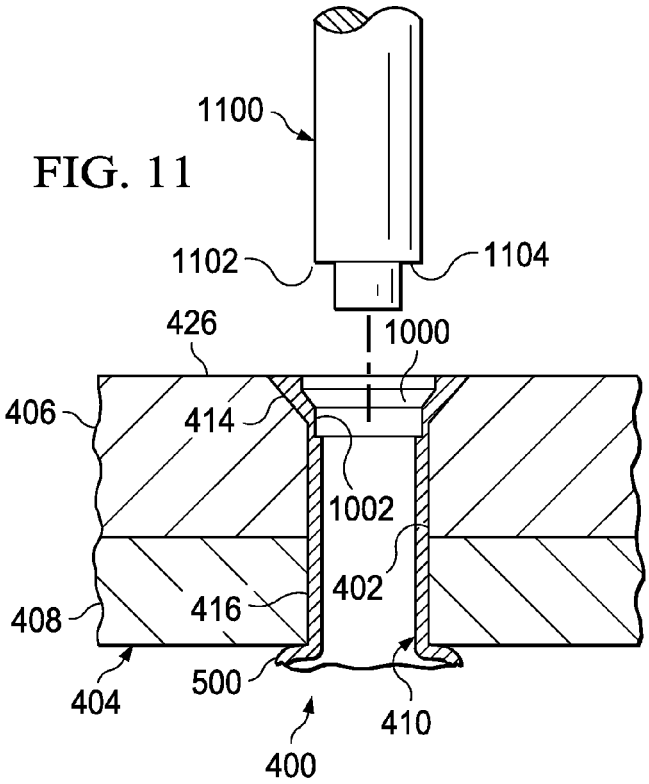
FIG. 11 is a diagram illustrating positioning of a step punch over a bore hole in accordance with an advantageous embodiment.

With reference now to FIG. 11, a diagram illustrating positioning of a step punch over a bore hole is depicted in accordance with an advantageous embodiment. In this example, step punch 1100 is positioned over counter bore 1000. Step punch 1100 has sharp edge 1102 at step 1104 of step punch 1100. Sharp edge 1102 may cause head 414 to separate from shaft 416 of body 410. Sharp edge 1102 may impact on cross section 1002 in its reduced form within body 410.

Figure 12:
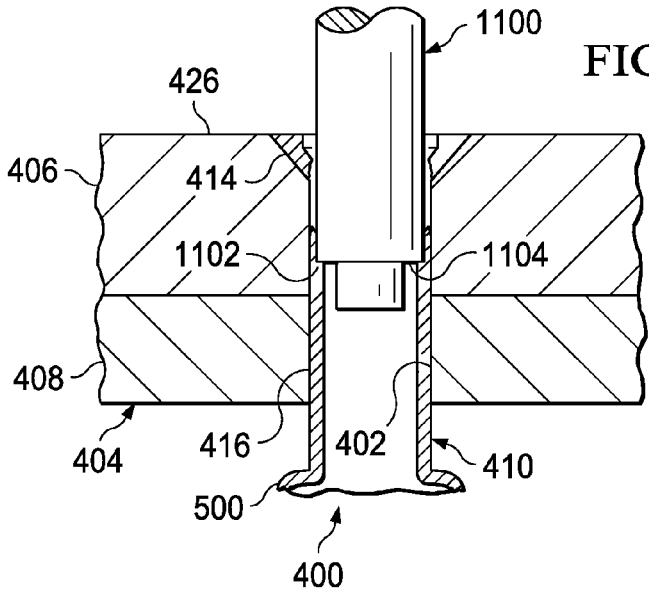
FIG. 12 is a diagram illustrating separation of a head from a shaft of a body in accordance with an advantageous embodiment.

With reference now to FIG. 12, a diagram illustrating separation of a head from a shaft of a body is depicted in accordance with an advantageous embodiment. In this example, head 414 is separated from shaft 416 through the application of force using step punch 1100. Shaft 416 of body 410 may be pushed through hole 402. This step completes the process for removing a blind fastener from a structure.

With reference now to FIG. 13, a table illustrating tools and depths needed to remove blind fasteners is depicted in accordance with an advantageous embodiment. In this example, table 1300 identifies tools and depths needed to remove fasteners of different sizes.

Column 1302 identifies a fastener size. Column 1304 identifies a diameter for a pilot hole. Column 1306 identifies a depth for a pilot hole. Column 1308 identifies a width of a hole to be drilled in the core bolt from the pilot hole. Column 1310 identifies a depth for the hole. Column 1312 identifies a counter bore drill diameter, while column 1314 identifies a depth for the counter bore. Column 1316 identifies a size for a step punch. In this example, table 1300 includes rows 1318, 1320, 1322, and 1324. These rows contain the information needed to remove blind fasteners of different sizes.

With reference now to FIG. 14, a diagram illustrating instructions is depicted in accordance with an advantageous embodiment. Instructions 1400 are an example of one implementation for instructions 306 in kit 302 in FIG. 3. These instructions may be electronic, on paper, or in some other suitable form for use by an operator. These instructions may be used along with the tools in a kit to remove blind fasteners from a structure.

Figure 15:
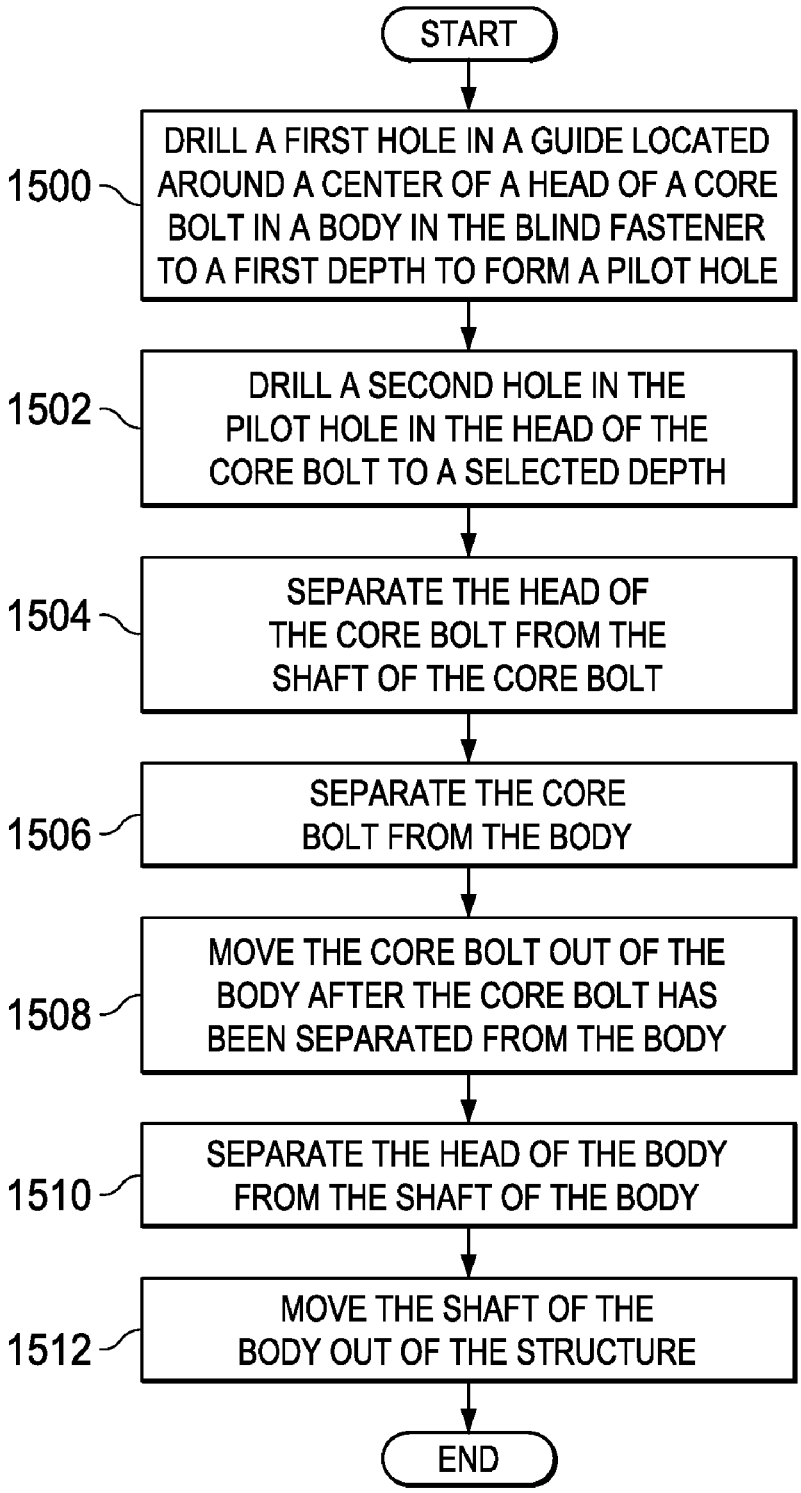
FIG. 15 is a flowchart of a process for removing a blind fastener in a structure in accordance with an advantageous embodiment.

With reference now to FIG. 15, a flowchart of a process for removing a blind fastener in a structure is depicted in accordance with an advantageous embodiment. The process illustrated in FIG. 15 may be implemented using blind fastener removal system 300 in FIG. 3. In particular, tools 304 in kit 302 may be used to remove blind fastener 308.

The process begins by drilling a first hole in a guide located around a center of a head of a core bolt in a body in the blind fastener to a first depth to form a pilot hole (operation 1500). A second hole is then drilled in the pilot hole in the head of the core bolt to a selected depth (operation 1502). The head of the core bolt is separated from the shaft of the core bolt (operation 1504). The core bolt is then separated from the body (operation 1506).

Operation 1504 may occur as a result of drilling the second hole in operation 1502. In other advantageous embodiments, operation 1504 may occur simultaneously with operation 1506. A punch may be used to separate the head of the core bolt from the shaft of the core bolt at the same time the core bolt is separated from the body.

The core bolt is moved out of the body after the core bolt has been separated from the body (operation 1508). The head of the body is separated from the shaft of the body (operation 1510). The shaft of the body is then moved out of the structure (operation 1512), with the process terminating thereafter.

Figure 16:
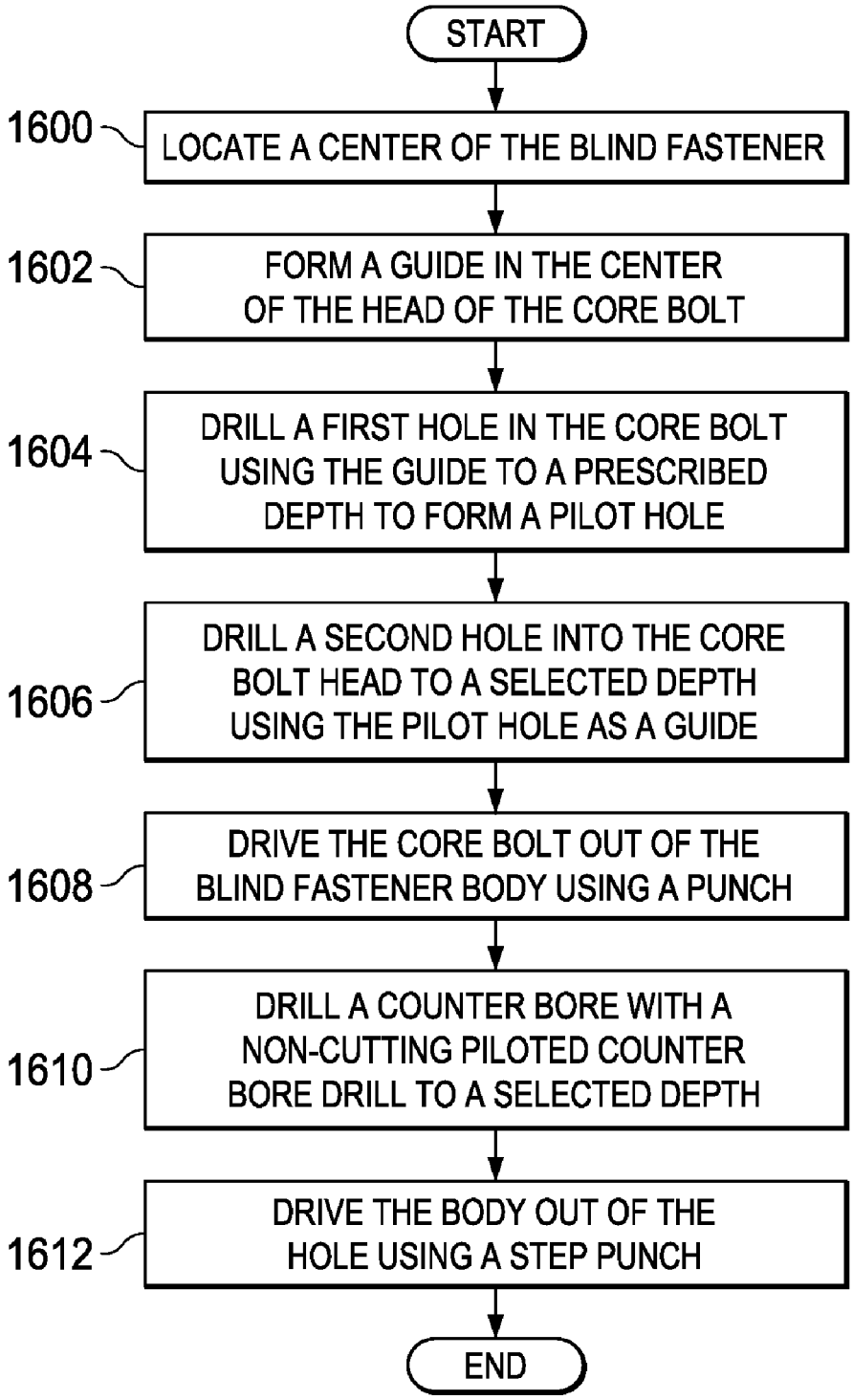
FIG. 16 is a flowchart of a process for removing a blind fastener from a structure in accordance with an advantageous embodiment.

With reference now to FIG. 16, a flowchart of a process for removing a blind fastener from a structure is depicted in accordance with an advantageous embodiment. The flowchart illustrated in FIG. 16 may be implemented using kit 302 in blind fastener removal system 300 in FIG. 3. This process is a more detailed illustration of steps that may be used to remove a blind fastener from a structure.

The process begins by locating a center of the blind fastener (operation 1600). Thereafter, a guide is formed in the center of the head of the core bolt (operation 1602). Operation 1602 may be performed using a center punch. The process then drills a first hole in the core bolt using the guide to a prescribed depth to form a pilot hole (operation 1604). The pilot hole acts as a guide for the next hole that is to be drilled into the core bolt head.

The process then drills a second hole into the core bolt head to a selected depth using the pilot hole as a guide (operation 1606). This operation may result in the head of the core bolt separating from the shaft of the core bolt. The process then drives the core bolt out of the blind fastener body using a punch (operation 1608). This operation also may be used to remove the head of the core bolt from the shaft of the core bolt if the head does not separate in operation 1606.

The process then drills a counter bore with a non-cutting piloted counter bore drill to a selected depth (operation 1610). A non-cutting part counter-bore drill may be a drill with a portion of a tip ground to a diameter smaller than the inside of the body diameter. This diameter may not cut material but may provide a guide for the counter-bore drill to counter bore the body to reduce the cross-section material of the body in the blind fastener. The process then drives the body out of the hole using a step punch (operation 1616), with the process terminating thereafter.

Thus, the different advantageous embodiments provide a method and apparatus for removing blind fasteners from a structure. The different advantageous embodiments provide an ability to move blind fasteners in a manner that reduces and/or eliminates damage to a structure in which the blind fasteners are secured. With this process, the removal of blind fasteners also may be performed at a faster rate. As a result, the time needed to perform maintenance and reworking may be reduced as well as the expense.

The different advantageous embodiments recognize and take into account that currently used processes for removing fasteners may result in damage to a structure. This damage may require repair and/or replacement of the structure. For example, when removing a blind fastener from a skin panel attached to an airframe, drilling of the head on the core bolt may result in damage to the skin panel if the drilling is not performed accurately. Further, with the accuracy needed to properly remove blind fasteners, the removal of blind fasteners may be a long and tedious process adding to the cost for maintenance or reworking of an aircraft. Additionally, this time also may increase the time that an aircraft is unavailable for service.

The description of the different advantageous embodiments has been presented for purposes of illustration and description, and is not intended to be exhaustive or limited to the embodiments in the form disclosed. Many modifications and variations will be apparent to those of ordinary skill in the art.

Although the different advantageous embodiments have been described with respect to aircraft, other advantageous embodiments may be applied to other types of objects. For example, without limitation, other advantageous embodiments may be applied to a mobile platform, a stationary platform, a land-based structure, an aquatic-based structure, a space-based structure and/or some other suitable object. More specifically, the different advantageous embodiments may be applied to, for example, without limitation, a submarine, a bus, a personnel carrier, a tank, a train, an automobile, a spacecraft, a space station, a satellite, a surface ship, a power plant, a bridge, a dam, a manufacturing facility, a building and/or some other suitable object.

Further, different advantageous embodiments may provide different advantages as compared to other advantageous embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A method for removing a blind fastener from a structure, the method comprising:

locating about a center of the blind fastener and a core bolt, wherein the fastener has a head and a body, and wherein the core bolt has a core bolt head and core bolt shaft, and wherein the core bolt shaft is located inside the body of the fastener and the bolt head is located on a same side as the head of the fastener;

creating a guide at about the center of the core bolt head;

drilling a first hole in the guide of the core bolt head in the body of the blind fastener to form a pilot hole to a first depth into the core bolt head;

thereafter drilling a second hole through the pilot hole, to about the first depth or when the core bolt head snaps off, whichever happens first;

responsive to the core bolt head failing to snap off when drilling the second hole through the pilot hole, separating the core bolt head from the core bolt shaft using a second tool different than a first tool used to drill the second hole;

applying sufficient force to remove the core bolt shaft from the body of the fastener;

separating the fastener head from the body of the fastener by drilling a counter bore into the body of the fastener to a predetermined depth; and;

moving the fastener body out of the structure.

2. The method of claim 1, further comprising:

creating the guide in the head of the core bolt with a center punch.

3. The method of claim 1, wherein the step of drilling the first hole is accomplished by drilling with a first drill bit having a first diameter.

4. The method of claim 1, wherein the step of drilling the second hole through the pilot hole is accomplished using a core bolt drill having a second diameter.

5. The method of claim 1, wherein the step of responsive to the core bolt head failing to snap off when drilling the second hole through the pilot hole, separating the core bolt head from the core bolt shaft using a second tool different than a first tool used to drill the second hole; and wherein the second tool comprises a rivet set tool and a rivet gun.

6. The method of claim 1, wherein the step of separating the fastener head from the body of the fastener by drilling a counter bore into the body of the fastener to a predetermined depth is accomplished by using a non-cutting piloted counter bore drill with a drill motor at less than a predetermined revolutions per minute.

7. The method of claim 1, wherein the separating the fastener head from the body of the fastener by drilling a counter bore into the body of the fastener to a predetermined depth step further comprises:

responsive to the head of the fastener failing to separate from the body of the fastener after drilling a counter bore into the body, inserting an end of a piloted step punch into the body of the fastener; and applying force to the counter bore using the piloted step punch such that the head of the body separates from the shaft of the body.

8. The method of claim 1, wherein the pilot hole is drilled using a first drill bit having a first diameter, wherein the second hole is drilled using a second drill bit having a second diameter, and wherein the first diameter is smaller than the second diameter.

9. The method of claim 1, wherein the structure comprises a plurality of parts.

10. The method of claim 1, wherein the structure is part of an object.

11. The method of claim 10, wherein the object is selected from one of a mobile platform, a stationary platform, a land-based structure, an aquatic-based structure, a space-based structure, an aircraft, a surface ship, a tank, a personnel carrier, a train, a spacecraft, a space station, a satellite, a submarine, an automobile, a power plant, a bridge, a dam, a manufacturing facility, and a building.

12. A method for removing a blind fastener from an aircraft part, the method comprising:

locating about a center of the blind fastener and a core bolt, wherein the fastener has a head and a body, and wherein the core bolt has a core bolt head and core bolt shaft, and wherein the core bolt shaft is located inside the body of the fastener and the bolt head is located on a same side as the head of the fastener;

utilizing a center punch to create a guide at about the center of the core bolt head;

drilling a first hole with a drill bit in the guide of the core bolt head in the body of the blind fastener to form a pilot hole a first depth into the core bolt head;

thereafter drilling a second hole through the pilot hole using a core bolt drill, to about the first depth or when the core bolt head snaps off, whichever happens first;

separating the core bolt head from the core bolt shaft by utilizing a rivet set tool and a rivet gun if the drilling of the second hole through the pilot hole to about the first depth using the core bolt drill did not already cause the core bolt head to snap off;

applying sufficient force to remove the core bolt shaft from the body of the fastener;

drilling a counter bore into the body of the fastener to a predetermined depth using a non-cutting piloted counter bore drill with a drill motor at less than a predetermined revolutions per minute;

inserting an end of a piloted step punch into the body of the fastener;

tapping the punch with a hammer or the rivet gun to remove the fastener head from the fastener body; and moving the fastener body out of the aircraft part.

13. The method of claim 12, wherein the blind fastener attaches a plurality of parts to each other in the aircraft part.

14. The method of claim 1, wherein the first depth is about ⅛ inches deep.

15. The method of claim 6, wherein the drilling of the non-cutting piloted counter bore drill is at a predetermined depth which is approximately the depth set forth in a fastener removal chart, and wherein the drill motor is operated at less than about 400 revolutions per minute.

* * * * *